US008936150B1

(12) United States Patent
Whaley

(10) Patent No.: US 8,936,150 B1
(45) Date of Patent: Jan. 20, 2015

(54) HANDBAG ADAPTED TO HOLD A FIREARM

(75) Inventor: Linda Whaley, Ballwin, MO (US)

(73) Assignee: Hide in Plain Sight Carry Systems, LLC, Ballwin, MO (US)

( * ) Notice: Subject to any disclaimer, the term of this patent is extended or adjusted under 35 U.S.C. 154(b) by 171 days.

(21) Appl. No.: 13/608,745

(22) Filed: Sep. 10, 2012

Related U.S. Application Data

(60) Provisional application No. 61/559,210, filed on Nov. 14, 2011.

(51) Int. Cl.
*B65D 85/00* (2006.01)

(52) U.S. Cl.
USPC ..... 206/317; 150/112

(58) Field of Classification Search
CPC ..... F41C 33/048; F41C 33/06
USPC ..... 206/317; 190/102, 109, 111; 150/112, 150/117
See application file for complete search history.

(56) References Cited

U.S. PATENT DOCUMENTS

| | | | | |
|---|---|---|---|---|
| 1,381,301 | A | 6/1921 | Hargrave | |
| 2,845,973 | A * | 8/1958 | Strong | 150/101 |
| 3,347,299 | A | 10/1967 | Alexander | |
| 5,170,919 | A | 12/1992 | DeSantis et al. | |
| 5,294,031 | A | 3/1994 | Volpei et al. | |
| 5,495,967 | A | 3/1996 | Parton | |
| 5,584,424 | A | 12/1996 | Stava | |
| 5,671,830 | A | 9/1997 | Wood | |
| 5,704,528 | A | 1/1998 | Faure | |
| 7,900,757 | B2 | 3/2011 | Sisitsky | |
| 2004/0163913 | A1 | 8/2004 | Tschudy | |
| 2006/0027293 | A1 | 2/2006 | Willems | |

OTHER PUBLICATIONS

"CCW Small Hiker Handgun Backpack Purse", http://www.ccwsupply.biz/CCWSmallHikerPAGE.htm, last visited Dec. 5, 2012, published at least as early as application filing date, 2 pages.
"Concealment Purses—GlockStore.com", http://glockstore.com/index/10/, last visited Dec. 5, 2012, published at least as early as application filing date, 2 pages.
"Coronado Leather American Mini Hobo—Handgun Purse", http://www.holsters4guns.com/holsters/product/A99.html, last visited Dec. 5, 2012, published at least as early as application filing date, 1 page.
"The Purse for Concealed Carry", http://www.gunreports.com/special_reports/accessories/concealed-carry-purse-self-defense-women388-1.html, last visited Dec. 5, 2012, published at least as early as application filing date, 2 pages.
"Your Gun Holster, Gun Purse and Leather Concealed Carry Source—Ray's Holsters", http://www.shado.com, last visited Dec. 5, 2012, published at least as early as application filing date, 2 pages.

* cited by examiner

*Primary Examiner* — David Fidei
(74) *Attorney, Agent, or Firm* — Thompson Coburn LLP

(57) ABSTRACT

A hand bag has a purse portion for personal items and a firearm compartment portion mounted to the purse portion for receiving a firearm. The firearm compartment portion has a base with a wall extending between the purse portion and the base. The firearm compartment portion has an access that allows a user to insert a user's hand through the firearm compartment access and grasp a firearm in the firearm compartment portion interior. The access has an opening in the wall with an edge at least a portion of which extends in a direction generally transverse to the firearm compartment base. The access has a closure movable between a first position in which the closure extends over the opening and a second position in which the closure extends away from the opening to allow a user to access the hollow interior.

19 Claims, 6 Drawing Sheets

HANDBAG ADAPTED TO HOLD A FIREARM

RELATED APPLICATION

This application claims the benefit of provisional application U.S. Ser. No. 61/559,210, filed on Nov. 14, 2011, the disclosure of which is incorporated by reference.

This relates to a handbag specifically adapted for concealed carry of a firearm.

Figure 1:
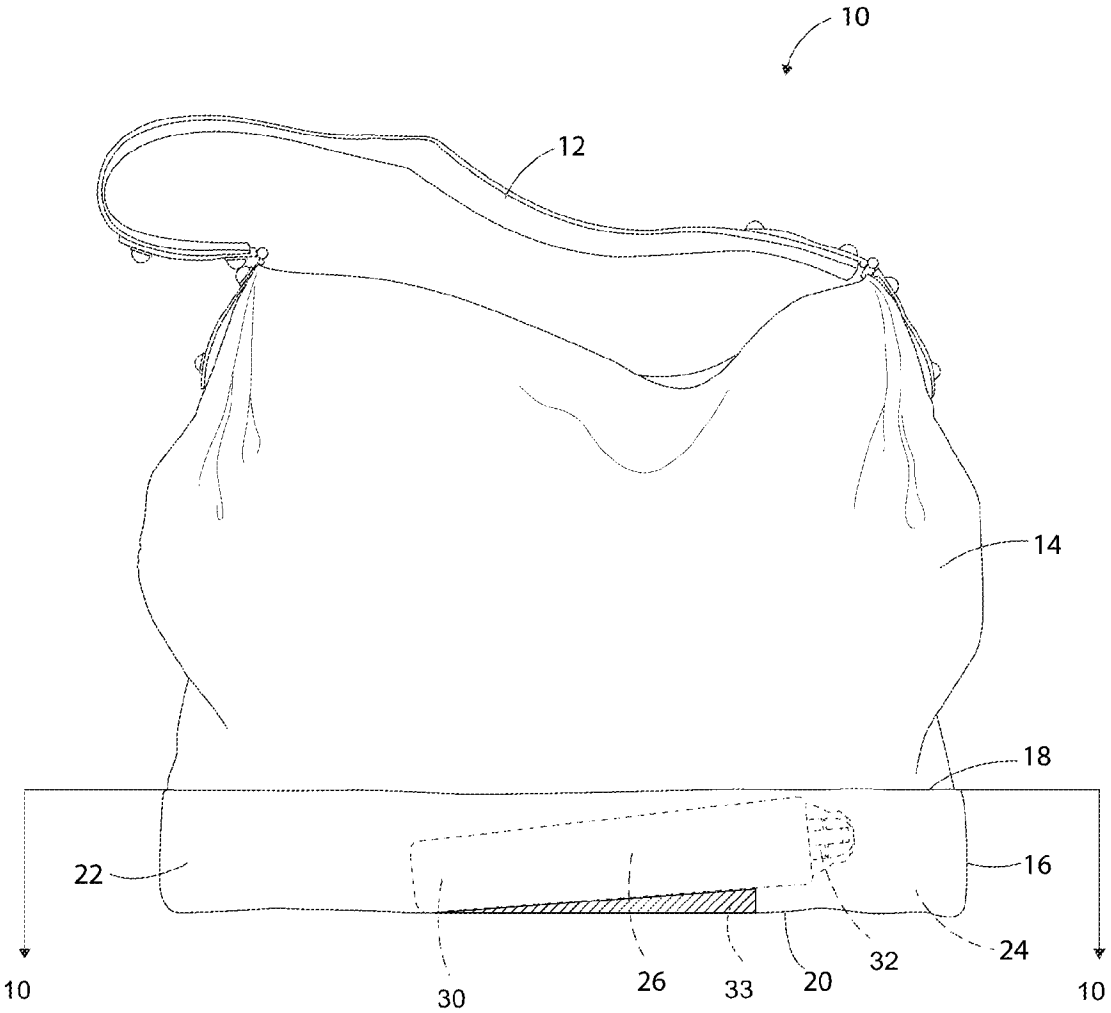
FIG. 1 is a front view of the handbag with the firearm shown in a lower compartment of the handbag in phantom.

The handbag 10 may include a carry strap 12 and have an upper compartment 14 as are usually associated with a handbag. The handbag may be leather, faux leather, fabric, or a combination of fabric materials and accessories with any variety of materials and may come in a variety of design styles and sizes. The upper compartment 14 holds items ordinarily associated with a handbag, i.e., cosmetics, wallet, sunglasses, and maybe sized accordingly.

Below the handbag upper compartment 14 is a structure 16 upon which a holster sits, i.e., a sit-upon holster. The sit-upon holster comprises a lower compartment structure below the upper compartment 14 and a holster element 28 for a firearm. The lower compartment structure of the sit-upon holster 16 may comprise opposite top and bottom panels 18,20 supported with side panels 22 extending between and/or around the periphery of the top and bottom panels to define a hollow interior or cavity 24 for the lower compartment structure. The top panel 18 of the lower compartment structure may be formed from the bottom of the upper compartment. In another embodiment, the top panel may be a separate panel formed to support the bottom of the upper compartment. That is, the top panel of the lower compartment structure may be a separate and distinct member from the bottom of the upper compartment, and the top panel of the lower compartment structure of the sit-upon holster and the bottom of the upper compartment may be placed in a face-to-face or abutting arrangement when the upper compartment and lower compartment structure is constructed of materials that coordinate with the overall design used for each handbag. The bottom of the upper compartment may have a flat appearance. In the alternative, the lower compartment structure may have slightly upward formed edges to define a rim and thus forming a shallow basin for the bottom of the upper compartment. The panels 18,20, 22 forming the lower compartment structure of the sit-upon holster may be formed from a rigid or firm material, such as, but not limited to, poly-thermal foam, plastic-like or other light weight metal alloy, and/or man-made material or reinforced fabric. The material chosen for the panels 18,20,22 forming the lower compartment structure preferably prevent the handbag upper compartment and contents from collapsing or deflecting down into the lower compartment structure. The lower compartment structure extends all the way around the bottom of the handbag, i.e., the width and length, to form the base of the handbag. The lower compartment structure of the sit-upon holster preferably has dimensions, i.e., width, length, and height, that are proportionally sized for the firearm 26 and holster element 28 internally housed in the lower base compartment. Accordingly, the sit-upon holster dimensions may be based on the dimensions for a particular firearm. The purse design style and/or size may vary depending upon the sit-upon holster size and the corresponding dimensions of a particular firearm.

The holster element 28 is housed in the hollow interior space 24 of the lower compartment structure forming the sit-upon holster 16. The holster element 28 sits upon or is releasably mounted to at least the interior bottom panel 20 of the lower compartment, and, or in the alternative, may be mounted to the lower compartment top panel 18, via hook and loop fasteners, mechanical snap fasteners, or an equivalent devices that allow the user to remove and/or reposition the holster in the lower base compartment. The holster element 28 may be made of sturdy leather, faux-leather, or other acceptable material, and may have a hook and loop, or other mechanical fastening feature, that mates with a like mechanical fastening mechanism in the interior space's mounting option. The holster element may have a graduated design. The graduated-holster may have a graduated depth or thickness from the front barrel end 30 to the rear grip end 32 of the holster (FIG. 1). The graduated thickness is intended to angle the rear grip of the firearm away from the bottom panel 20 where the holster is secured to the bottom and/or top of the lower base compartment. The graduated holster may comprise a straight holster with a tapered insert 33 between the holster and the bottom panel, or top panel depending on how the holster is secured in the interior of the lower compartment structure. The tapered insert may be releasably mounted to the holster element and/or one or more panel(s) in the lower compartment structure. The insert may also be integrally formed with the holster element. The graduated-holster or taper angle design positions the firearm, when holstered, so the grip of the firearm is positioned sufficiently away from the "sit-upon" holster" compartment panels to promote a more secure and unobstructed grip.

Figure 10:
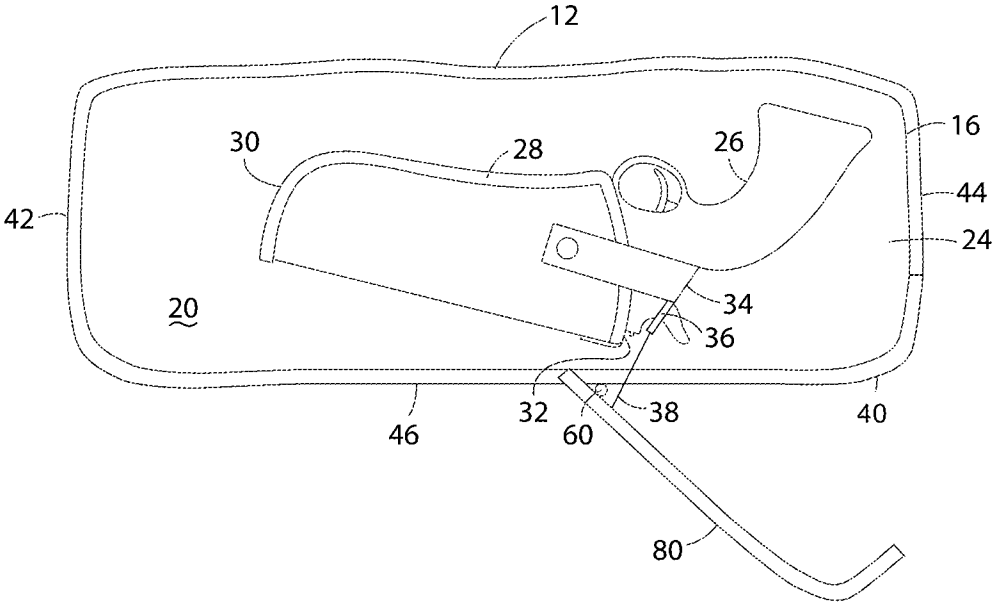
FIG. 10 is top plan view of the lower compartment interior taken along section lines 10-10 of FIG. 1.

Referring to FIG. 10, the firearm may be secured within the holster or graduated holster by applying a retention strap or thumb-break 34. The thumb break 34 feature may assist a user in retaining the firearm 26 in the holster 28 when the firearm is stored in purse and carried by the wearer. The thumb-break 34 may also be adjustably releasable from the holster to allow either a right or left-handed user to manipulate appropriate placement of the thumb-break to secure the firearm in the holster or to allow the wearer to remove the thumb-break when not desired. The thumb-break holster connection may be adjusted by mating the hook and loop material on an end of the thumb break to matching the hook and loop material on the holster. The thumb break 34 may also have hook and loop or equivalent material, and may have a ring-like tab 36, or similar element incorporated on its end to enable a right-handed or left-handed user to pull the ring-like element to disengage the strap from the holster. By way of example, and not in any limiting sense the thumb-break may be engaged relative to semi-automatic pistols, by manipulating the strap between the hammer and the slide of a single action firearm; relative to a revolvers with an exposed hammer, by manipulating the strap behind the hammer in its forward most resting position; relative to a revolver with a shrouded hammer, by manipulating the retention strap behind the recoil shoulder on the pistol's grip; relative to a striker fired weapon, across the rear of the slide; or relative to a de-cocked double-action weapon, behind the hammer. To extract the firearm 26 from the holster element 28, the thumb-break may be manually disengaged. For instance, if provided, a ring or tab, may be pulled in an outward motion, disengaging the hook and loop connection of the thumb break, or the connection may be disengaged by asserting pressure on the connection during the extraction of the firearm from the holster.

The purse may also include a remote release or pull 38 for the thumb break. The thumb-break pull 38 may be a light weight metal, alloy, plastic hook or malleable wire or material operatively connected to the handbag's access flap (FIGS. 2-5 (50), FIGS. 6-9 (80)). For instance, the thumb-break pull may be tautly connected with the access opening. The thumb-break pull 38 may be set at the time the firearm is placed in the holster. The thumb-break pull 38 may have an end with a loop that engages the connection of the thumb-break tab 36. Alternatively, the thumb-break pull may have an end that engages the connection of the thumb-break to the holster base. The thumb break pull 38 may be set with the access flap in a partially or semi-closed position allowing the user to set the thumb break pull with the thumb-break 34. Once the firearm is secured in the holster and holster installed in the lower compartment, the access flap may be fully closed. When the access flap is opened, i.e., for instance by pulling outwardly away from the handbag, the taut or rigid connection between the thumb-break pull 36 and the access will cause disengagement of the thumb break connection, thereby facilitating extraction of the firearm from the holster by minimizing the number of movements performed to retrieve the holstered firearm.

The holster element 28, whether graduated or flat, may be sold together with the purse or sold as an accessory item for use with the purse, depending upon the number of different sized firearms owned by the wearer and the wearer's desire to use different size firearms with the same purse. Because the holster is removably secured to the interior surfaces of the panels of the lower compartment structure of the sit-upon holster, a different holster element may be used in the sit-upon holster as desired by the wearer. The wearer may use a conventional or other commercially available holster as the holster element in the sit-upon holster by applying hook and lock material or other means for releasably securing the holster with the interior surfaces of the lower compartment structure. The holster element may be sized depending upon the type and/or size of the firearm, and/or the size of the purse.

Figure 3:
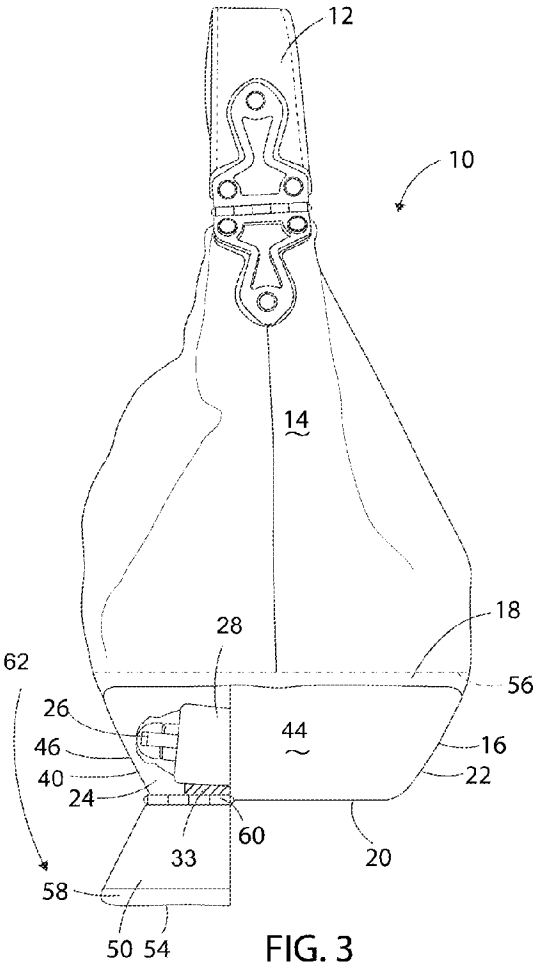
FIG. 3 is a right side view of the handbag of FIG. 2.
Figure 2:
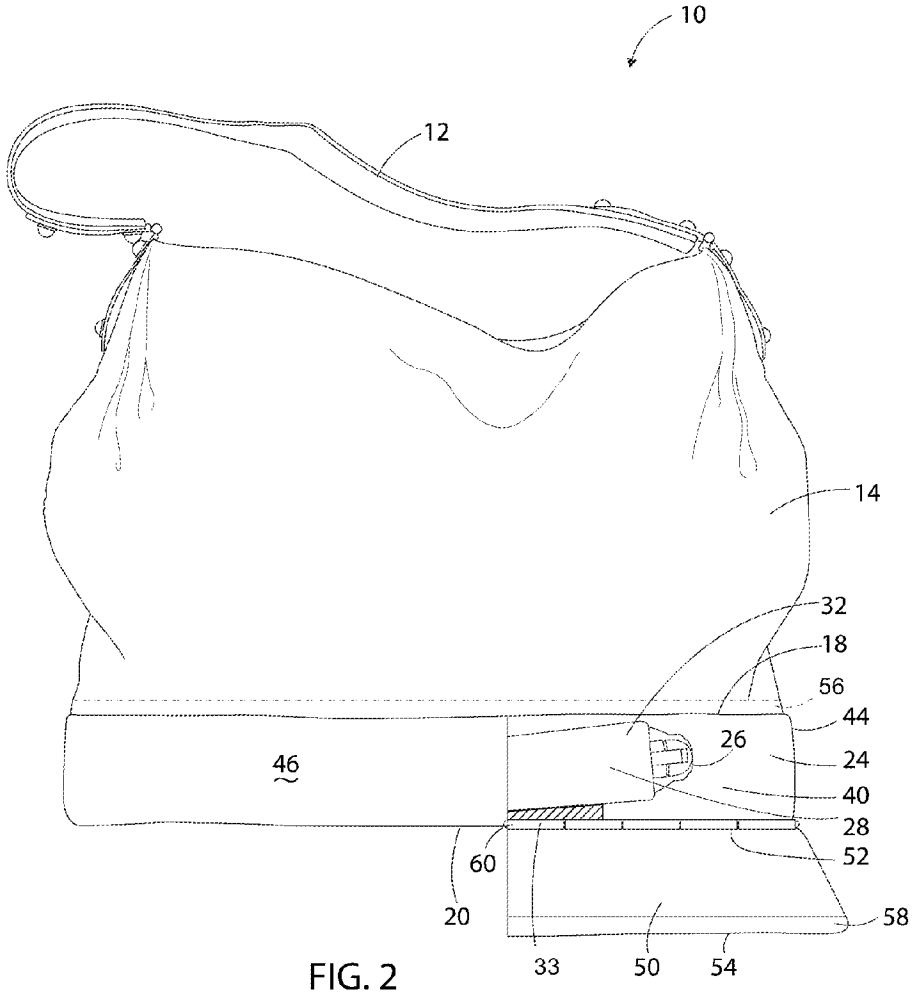
FIG. 2 is a rear view of the handbag of FIG. 1 showing a first embodiment of an access in the lower compartment for a right handed user.
Figure 5:
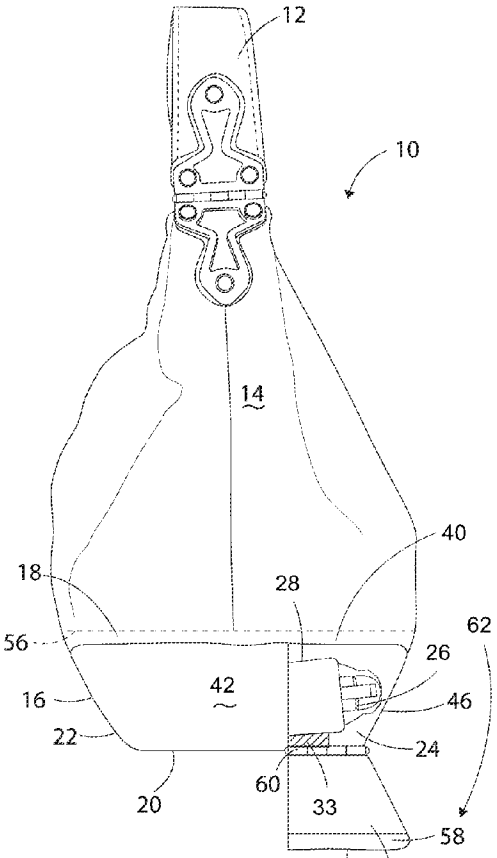
FIG. 5 is a left side view of the handbag of FIG. 4.
Figure 4:
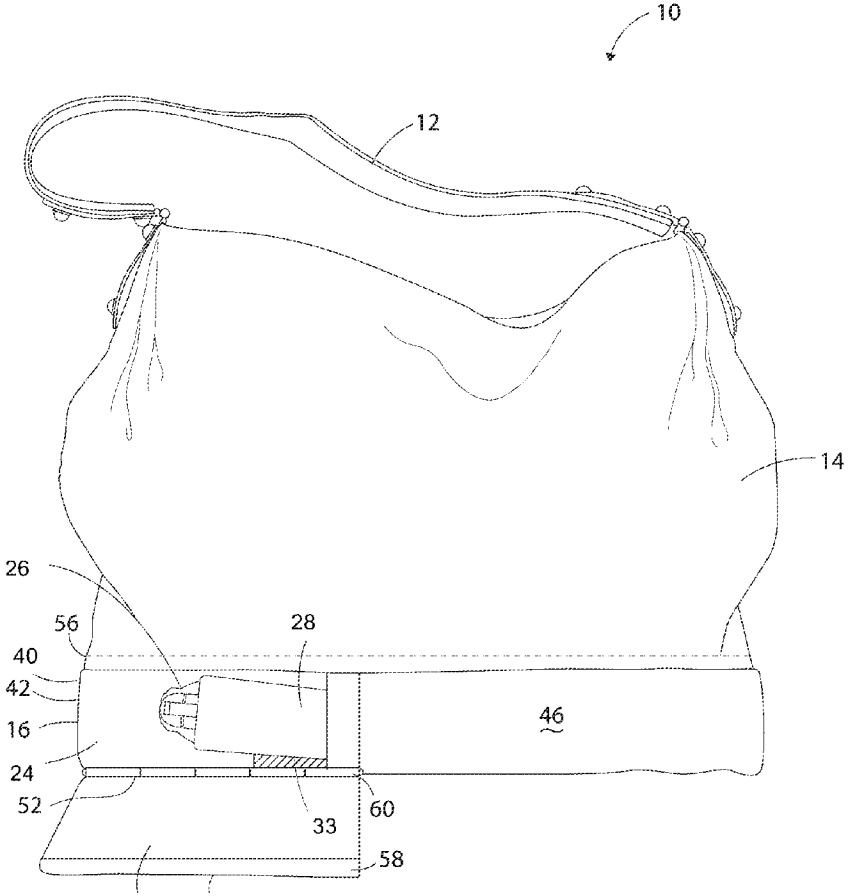
FIG. 4 is a rear view of the handbag of FIG. 1 showing a first embodiment of an access in the lower compartment for a left handed user.

As shown in FIGS. 2-5, the lower base compartment 16 has at least one access opening 40 in the side panel 22 at lateral sides 42, 44 and/or rear side 46 of the handbag. The access opening 40 preferably opens outward to allow access into the interior 24 of the lower compartment structure of the sit-upon holster 16 allow the user or wearer access to the holster element 28 for the placement and/or extraction of a firearm. Preferably, the access opening 40 is sized to allow a user's hand or fingers to enter the interior space of the lower compartment structure and grasp the firearm. The access opening 40 is preferably the sole entry into the lower compartment structure of the sit-upon holster. The access opening 40 is preferably covered when not in use by a flap 50 that extends over the access opening. As shown in FIGS. 2-5, the flap pivots horizontally. The flap 50 may be movable between a first position in which the access opening 40 is sufficiently opened or unobstructed for placement and/or extraction of a firearm into and out the lower compartment structure of the sit-upon holster and a second position in which the flap extends over the opening to obscure the opening and the contents contained in the interior space of the lower compartment structure. As shown in FIGS. 2-3, there may be an access on the right lateral side 44 that extends to the rear side of the handbag 46 or a rear only access (i.e., the rear is the side of the bag that faces or is adjacent to the person) of each handbag. As shown in FIGS. 4-5, there may be an access on the left lateral side 42 that extends to the rear side of the handbag 46 or a rear only access. Alternatively, a left and right access may be provided on the same purse. The left and right accesses simplify manufacturing by allowing a left-handed user and a right-handed user to use the same purse. The access(es) allow the wearer or user of the handbag to reach into the lower base compartment and extract a firearm securely disposed in the sit-upon holster.

The releasable securing mechanism for the flaps 50 is arranged to meet the concealability and overall artistic, aesthetic, and design aspects of the handbag while providing a secure, virtually indistinguishable as well as inaudible manipulation of the flap to gain access through the access opening into the interior of the lower base compartment.

In the embodiment of FIGS. 2-5, the flap 50 is arranged to extend between the lower base compartment bottom panel 20 and the handbag upper compartment 14 and pivot away from the lower compartment 16 thereby allowing the freedom of movement away from the handbag when accessing the interior of the lower base compartment, i.e., the "sit-upon holster" and supports movement towards the handbag portion of the upper compartment to seal the access. The flap need only cover the access and extending across the lower compartment structure is not necessary. The flap 50 may have a proximal end 52 with a pivot connection with the bottom panel 20 that extends along an axis that is generally parallel to and preferably co-linear with the bottom panel of the lower compartment. In such an arrangement, the flap distal end 54 may be releasably secured to the exterior of the upper compartment with a design element, such as a hand bag flap lock, or a visibly undetected material 58, for instance, a magnetic tape, magnet buttons, or other material. The pivot connection may also comprise a single action spring hinge that may be incorporated in the access flap. For instance, a single action spring hinge 60 with sufficient bias to force the access flap against the purse sidewalls may be used. The spring hinge 60 may be formed integral with the bottom panel 20 and the access flap to preserve aesthetic appeal of the purse and to maintain the smooth appearance and transition around accesses of the lower compartment so the accesses remain substantially visually undetectable. The spring hinge may also be a separate element with one end of the spring hinge coupled to the bottom panel 20 of the lower compartment and the other end of the spring hinge coupled to the access flap.

Magnetic material 56 may be positioned horizontally in the interior bottom edge of the upper compartment 14, and magnetic material 58 on the distal end 54 of the flap 50 may be brought in proximity to the magnetic material 56 of the interior bottom edge to releasably seal the flap over the access opening based on the magnetic pull of the magnets. In this arrangement, the distal end of the flap 54 may be operated with one hand behind the handbag to pull the flap distal end (FIG. 3 (62)) downward to pivot the flap distal end away from the upper compartment thereby enabling the user to access the opening and interior and grasp the firearm with a preferred firing hand, and extract the firearm from the interior of the lower base compartment.

Figure 7:
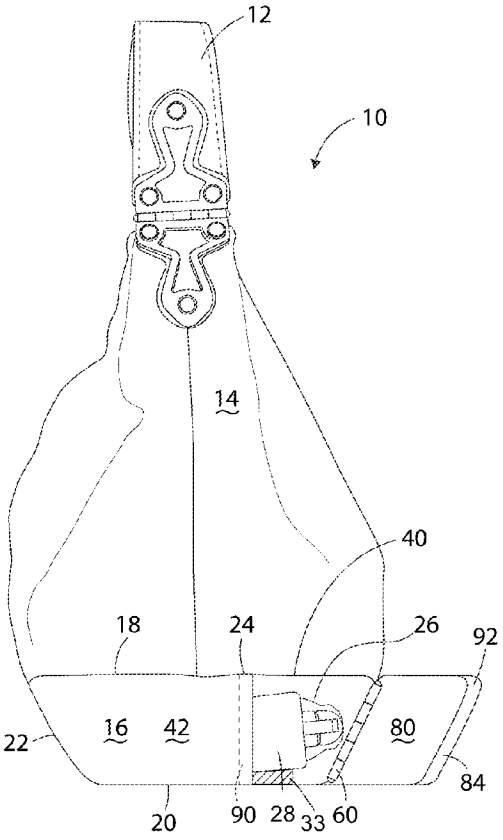
FIG. 7 is a left side view of the handbag of FIG. 6.
Figure 6:
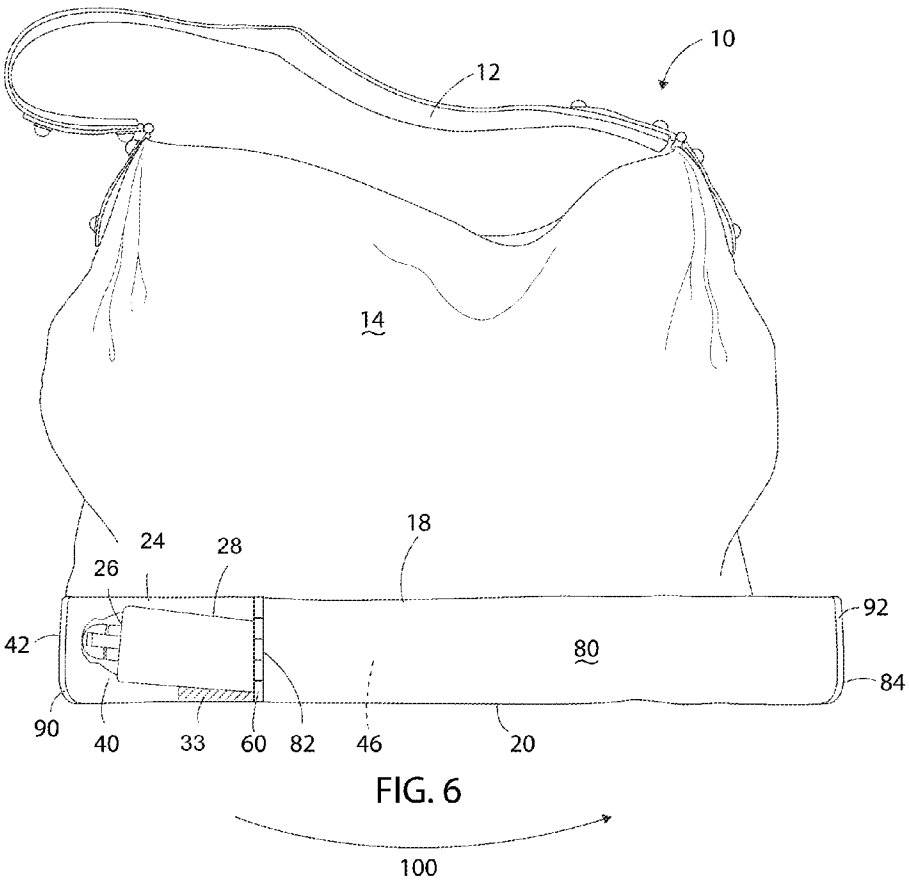
FIG. 6 is a rear view of the handbag of FIG. 1 showing an alternate embodiment of an access in the lower compartment.
Figure 9:
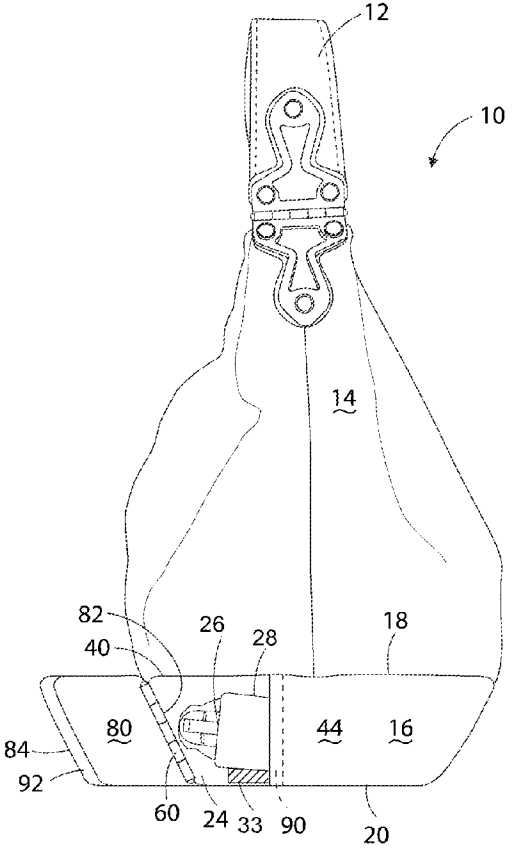
FIG. 9 is a right side view of the handbag of FIG. 8.
Figure 8:
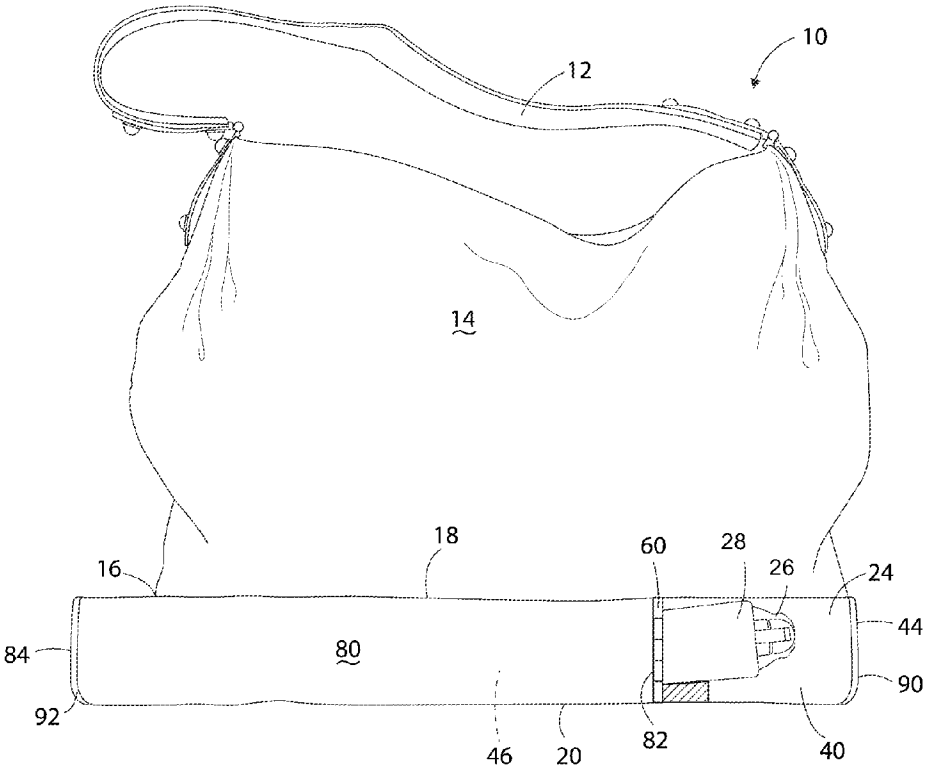
FIG. 8 is a rear view of the handbag of FIG. 1 showing an alternate embodiment of an access in the lower compartment.

In the alternative to the embodiments shown in FIGS. 2-5, the hand bag, as shown in FIGS. 6-9 may have an access flap with a pivot axis in the vertical direction as shown in the drawing. The access may be releasably attachable to the lower compartment to enclose the interior of the lower base compartment until access is desired. In FIGS. 6-7, a left access flap is shown open, and in FIGS. 8-9, a right access is shown open. It should be appreciated that the handbag may have both left and right flaps to accommodate left and right-handed users or a rear-only access flap and the Figures only show one access flap for ease of illustration. The flap 80 may have a proximal end 82 that pivots along an axis that is perpendicular to the bottom panel 20 and a distal end 84 that extends vertically adjacent a lateral side 42,44 of the handbag. In such an arrangement, the proximal end 82 of the flap is attached to the side panel 22 at the rear side 46 of the handbag and the distal end 84 of the flap is positioned adjacent to the lateral sides 42,44 of the lower compartment when sealing the access opening. In such an arrangement, the flap distal end 84 is releasably secured to the exterior of the lower compartment with a design element, such as a hand bag flap lock, or a visibly undetected material 92, such as magnetic tape, magnet buttons, or other material. A single action spring hinge 60 as described previously may also be used. Additionally, magnetic material 90 may be positioned in a vertical orientation in the interior of the lower compartment at the lateral sides 42,44 of the side panel 22, and magnetic material 92 on a distal end 84 of the flap may be brought in proximity to the magnetic material of the interior lateral (and vertical) side edges 42,44 adjacent to the opening to releasably seal the flap 80 over the respective access opening 40. In this arrangement, the distal end 84 of the flap may be operated with one hand behind the handbag to pull the flap sideways (FIGS. 6,8 (100)) to pivot the distal end of the flap away from a front-mid side panel thereby enabling the wearer to access the opening and interior and grasp the firearm with a preferred firing hand, and extract the firearm from the interior of the lower base compartment.

The access opening and flaps shown in the drawing figures are intended to illustrative and not limiting in any sense. The accesses are preferably arranged toward the rear and sides or only from the rear of the lower compartment structure of the sit-upon holster so as to be obscured as much as practical against the wearer's body and to allow the wearer easy access to the sit-upon holster while allowing the wearer's movements in accessing the access to be as obscured as much as practical between the handbag and the wearer's body. Thus, the access may open in variety of ways including a combination of that shown in the drawings of FIGS. 2-9 depending upon the application, size and type of firearm, size of purse, and wearer's preference.

While specific embodiments have been described in detail and in the foregoing detailed description and illustrated in the accompanied drawings, those with ordinary skill in the art will appreciate that various modifications and alternatives to those details could be developed in light of the overall teachings of the disclosure. Accordingly, the specific embodiments disclosed and particular ranges disclosed were meant to be illustrative only and not limited as to the scope of the invention, which is to be given the full breath of the appended claims and any and all equivalents thereof.

What is claimed is:

1. A hand bag comprising:

a purse portion having purse sides extending around a purse base, the purse sides and the purse base defining a generally hollow interior of the purse portion, the purse portion having a purse access configured to allow a user to deposit personal items therethrough into the purse hollow interior;

a firearm compartment portion mounted to the purse portion, the firearm compartment portion having a firearm compartment base with a firearm compartment wall extending generally around a peripheral edge of the purse base and generally around a peripheral edge of the firearm compartment base, the firearm compartment wall extending between the purse base and the firearm compartment base, the firearm compartment wall, firearm compartment base, and the purse base together defining a hollow interior of the firearm compartment portion, the firearm compartment portion hollow interior being dimensioned to receive a firearm, the firearm compartment portion having a firearm compartment access of sufficient dimensions to allow a user to insert a user's hand through the firearm compartment access and grasp a firearm in the firearm compartment portion hollow interior, the firearm compartment access being defined by an opening in the firearm compartment wall, the opening having an edge, at least a portion of the edge extending in a direction generally transverse to the firearm compartment base, the firearm compartment access comprising a closure movable between a first position in which the closure extends over the opening and a second position in which the closure extends away from the opening to allow a user to access the hollow interior; and a holster for the firearm in the firearm compartment.

2. The hand bag of claim 1, wherein the hand bag has user carrying straps operatively attached to the purse portion.

3. The hand bag of claim 1, wherein the purse portion sides smoothly transition to firearm compartment wall.

4. The hand bag of claim 1, wherein the holster is releasably mounted to the firearm compartment base.

5. The hand bag of claim 1, wherein the holster has an angled portion forming a mount between the holster and firearm compartment base.

6. The hand bag of claim 1, wherein the holster comprises a retention strap adapted to be engaged to restrict discharge of the firearm when the firearm is holstered and disengaged to allow removal of the firearm from the holster.

7. The hand bag of claim 6, wherein the holster retention strap is configured to be operatively connected to the closure such that movement of the closure to the second position disengages the retention strap.

8. The hand bag of claim 1, wherein the closure is releasably securable to the firearm compartment wall in the first position.

9. The hand bag of claim 1, wherein the closure is pivotally coupled to the firearm compartment base to move between the first and second positions.

10. The hand bag of claim 1, wherein the firearm compartment wall has sufficient rigidity to support the purse portion and maintain the hollow interior of the firearm compartment portion with the firearm received therein.

11. A hand bag comprising:

a purse portion having purse sides extending around a purse base, the purse sides and the purse base defining a generally hollow interior of the purse portion, the purse portion having a purse access configured to allow a user to deposit personal items therethrough into the purse hollow interior;

a firearm compartment portion comprising a firearm compartment base having an outer periphery, the firearm compartment base spaced from the purse base by a front wall, a rear wall, and left and right side walls, the front wall being adapted to be positioned away from a user when the hand bag is carried by a user, the rear wall being generally opposite the front wall and adapted to be adjacent a user when the hand bag is carried by a user, the left and right side walls extending between the front and the rear walls, the front wall, the rear wall, and the left and right side walls being mounted to the purse portion, the front wall, the rear wall, the left and right side walls, the firearm compartment base, and the purse base together defining a hollow interior of the firearm compartment portion, the firearm compartment portion hollow interior being dimensioned to receive a firearm, the firearm compartment portion having a firearm compartment access being of sufficient dimensions to allow a user to insert a user's hand through the firearm compartment access and grasp a firearm in the firearm compartment portion hollow interior, the firearm compartment access being defined by an opening generally formed in the rear wall and at least a portion of one of the left and right side walls, the opening having an edge, at least a portion of the edge extending in a direction generally transverse to the firearm compartment base, the firearm compartment access comprising a closure movable between a first position in which the closure extends over the opening and a second position in which the closure extends away from the opening to allow a user to access the hollow interior; and a holster for the firearm in the firearm compartment.

12. The hand bag of claim 11, further comprising a second firearm compartment access being defined by an second opening generally formed in the rear wall and at least a portion of the other of the left and right side walls, the second opening having an edge, at least a portion of the edge extending in a direction generally transverse to the firearm compartment base, the second firearm compartment access comprising a second closure movable between a first position in which the second closure extends over the second opening and a second position in which the second closure extends away from the second opening to allow a user to access the hollow interior.

13. The hand bag of claim 11, wherein the holster is releasably mounted to the firearm compartment base.

14. The hand bag of claim 11, wherein the holster has an angled portion forming a mount between the holster and firearm compartment base.

15. The hand bag of claim 11, wherein the holster comprises a retention strap adapted to be engaged to restrict discharge of the firearm when the firearm is holstered and disengaged to allow removal of the firearm from the holster.

16. The hand bag of claim 15, wherein the holster retention strap is configured to be operatively connected to one of the closures such that movement of the closure to the second position disengages the retention strap.

17. The hand bag of claim 12, wherein the first and second closures are releasably securable to the firearm compartment rear wall in the first position.

18. The handbag of claim 12, wherein the first and second closures are pivotally coupled to the firearm compartment base to move between the first and second positions.

19. The hand bag of claim 11, wherein the front wall, the rear wall, and the left and right side walls has sufficient rigidity to support the purse portion and maintain the hollow interior of the firearm compartment portion with the firearm received therein.

* * * * *